US009816275B2

(12) United States Patent
Smith

(10) Patent No.: US 9,816,275 B2
(45) Date of Patent: Nov. 14, 2017

(54) MODULAR PRECAST CONCRETE STEPS

(71) Applicant: William H. Smith, Manlius, NY (US)

(72) Inventor: William H. Smith, Manlius, NY (US)

( * ) Notice: Subject to any disclaimer, the term of this patent is extended or adjusted under 35 U.S.C. 154(b) by 0 days.

(21) Appl. No.: 15/386,002

(22) Filed: Dec. 21, 2016

(65) Prior Publication Data

US 2017/0234014 A1 Aug. 17, 2017

Related U.S. Application Data

(60) Provisional application No. 62/295,529, filed on Feb. 16, 2016.

(51) Int. Cl.
*E04F 11/00* (2006.01)
*E04F 11/035* (2006.01)
*E04F 11/116* (2006.01)

(52) U.S. Cl.
CPC ..... *E04F 11/035* (2013.01); *E04F 11/116* (2013.01)

(58) Field of Classification Search
CPC ..... E04F 11/116; E04F 11/035; E04F 11/022; E04F 11/025; E04F 11/09; E04F 2011/0212
See application file for complete search history.

(56) References Cited

U.S. PATENT DOCUMENTS 1,265,949 A * 5/1918 Osborn ..... E04F 11/022 52/189
1,497,058 A * 6/1924 Barriball ..... E04F 11/025 52/190
1,861,751 A * 6/1932 Nicols ..... E04F 11/035 52/189
1,963,866 A * 6/1934 Peterson ..... E04F 11/022 249/14
2,044,260 A * 6/1936 Schiele ..... E04F 11/022 52/184
2,171,951 A * 9/1939 Rosenberger ..... E04F 11/022 52/189
2,615,325 A * 10/1952 Seeber ..... E04F 11/022 52/190

(Continued)

FOREIGN PATENT DOCUMENTS

JP 2008111290 A * 5/2008

*Primary Examiner* — Gisele Ford
(74) *Attorney, Agent, or Firm* — Bernhard P. Molldrem, Jr

(57) ABSTRACT

A precast concrete step unit formed of left and right sidewalls, risers, and treads, wherein left and right sidewalls are assembled from a plurality of pre-cast sidewall panel modules, including at least one stepped panel module and at least one rectangular panel module. The panel modules are joined edge-to-edge at seams, with cement and/or with hardware. Pre-cast concrete tread modules extend at least between the left and right sidewalls and are mounted onto respective stepped edge surfaces of the right and left sidewalls. Pre-cast concrete riser modules also extending at least between the right and left sidewalls and mounted onto tread modules. These each extend vertically to successive stepped edge surfaces. Reinforcing cross brace members are fastened to the inward surfaces of the left and right sidewalls and extend at crossed diagonals between them. The precast modules each weight about 200 pounds or less and can be carried by two workmen. One-piece concrete footing pieces can be used to support the lower edges of the sidewall panel modules.

13 Claims, 5 Drawing Sheets

(56) References Cited

U.S. PATENT DOCUMENTS

| | | | | | |
|---|---|---|---|---|---|
| 2,697,931 | A * | 12/1954 | Schill | E04F 11/025 52/189 |
| 2,722,823 | A * | 11/1955 | Summers | E04F 11/022 52/189 |
| 2,885,883 | A * | 5/1959 | Torricelli | E04F 11/022 52/189 |
| 3,025,639 | A * | 3/1962 | Lemieux | E04F 11/022 52/189 |
| 3,055,146 | A * | 9/1962 | Lobato | B28B 7/225 249/14 |
| 3,706,170 | A * | 12/1972 | Argraves | E04F 11/022 52/182 |
| 3,986,579 | A | 10/1976 | Howard et al. | |
| 4,042,064 | A * | 8/1977 | Lobb | E01F 1/00 182/115 |
| 4,328,651 | A * | 5/1982 | Gutierrez | E02D 27/02 52/169.9 |
| 5,511,347 | A | 4/1996 | Schwarz | |
| 6,029,408 | A | 2/2000 | Cavaness | |
| 6,412,244 | B2 | 7/2002 | Nolan | |
| 6,837,013 | B2 | 1/2005 | Foderberg et al. | |
| 8,132,388 | B2 | 3/2012 | Nagy et al. | |
| 8,627,926 | B2 * | 1/2014 | Gordon | E04F 11/02 182/115 |
| 8,800,232 | B1 | 8/2014 | Keenan | |
| 9,499,984 | B2 | 11/2016 | Manning | |
| 2004/0040229 | A1 * | 3/2004 | Torch | E04F 11/035 52/189 |
| 2004/0040785 | A1 * | 3/2004 | Robinson | E04F 11/025 182/115 |
| 2007/0261324 | A1 * | 11/2007 | Munson | E04F 11/116 52/177 |
| 2009/0056253 | A1 * | 3/2009 | Davis | E02D 27/16 52/292 |

* cited by examiner

MODULAR PRECAST CONCRETE STEPS

This application claims priority under 35 U.S.C. 119(e) of provisional patent application Ser. No. 62/295,529, filed Feb. 16, 2016,and the disclosure of which is incorporated by reference herein.

BACKGROUND OF THE INVENTION

The present invention relates to pre-cast concrete articles, and in particular to pre-cast concrete steps that can be used at the entrance to a home or other building structure.

Typically, present-day concrete steps are molded or formed as a one-piece unit; at a factory or central work site, and are delivered in that form to the job site for installation on a building. These one-piece units are quite heavy, e.g., 2,000 pounds or more, and they require a crane or other heavy equipment to lift and move them to the proper location. In many cases it is not practical to bring the heavy equipment to the location where the steps are to be installed, and this can create a large additional expense. Also, most manufacturers produce only a limited variety in terms of style and size, i.e., height and width of the precast steps, and the selection may or may not include steps that are correct for the given building. Further, the steps are limited in available designs, surface textures, or other features that a customer may want for the project.

OBJECTS AND SUMMARY OF THE INVENTION

In order to address these shortcomings, the inventor herein is proposing a modular system of assembling pre-cast concrete steps on-site, using pre-fabricated side wall panel modules, riser modules, tread modules, and platform modules. These pre-cast concrete modules are designed to weigh not more than 250 pounds, preferably about 200 pounds each, or less, so that one or two installation workers can easily carry each module from a truck bed to the installation location. These pre-cast panel modules, tread modules, riser modules, etc. can have any desired surface texture (e.g., natural rock finish, smooth finish, sand finish, etc.) and in the customer's choice of color or style (e.g. bull-nose treads). By using more or fewer side panels the side walls of the steps can be made higher (with more steps) or lower (with fewer steps) and can have a long or short platform behind the top step. A third side panel wall, identical to the left or right side walls, can be placed between the two side walls as a support for wider risers and treads, i.e., supporting longer spans and permitting construction of extra-width steps.

The steps can be installed using internal brackets, bracing, and doweling, to make the steps suitable for long service. The modular system makes it possible to replace worn or damaged side panels, risers, or platform modules, rather than replacing an entire step unit.

The modular precast concrete steps that maybe constructed according to the main principles of this invention, are shown in the attached drawing figures. This type of modular step unit allows anyone to assemble it, with any desired amount of rise and at any width, and with or without a platform.

Riser heights can be made shorter than standard to allow for different building codes or to accommodate elderly persons. Greater widths can be obtained by adding one or more center supports, in the form of an additional side wall unit to decrease the span for the risers and platforms. Railings can be bolted to the top of the treads and the platforms. Most or all the individual modules do not exceed 250 pounds, and can be handled by two persons.

Modular components can be doweled and aligned with or without a "V" or ship-lapped joint. The modules can be joined using a standard mortar, but could be permanently glued with a construction adhesive. Alternatively, the modules maybe held together using dowels and bolts, so that the stair unit can be disassembled (at least in part), e.g., to repair or replace a damaged stair tread or wall panel.

The components can be reinforced with fiber and/or steel. The inner surfaces of the risers, treads, side wall panels, and platform panels can be embossed, i.e., recessed in places, so as to relieve some of the weight of the module without loss of strength.

Decorative designs may be incorporated into the surface of the side wall modules as well as treads, risers, e.g., stone, brick, stucco surfaces, etc., and these can be color treated as desired.

Cross bracing can be easily installed to align side wall panels and can give extra stability to higher units. Steel, plastic, or composite reinforcing plates can be used to align the components on larger units and achieve increased stability.

Features and Advantages of Modular Concrete Steps

The major features and advantages of this invention are as follows:

The steps can be customized for different size spaces and different size concrete slabs.

The panels can be joined with keyway joints or pinning Pins or dowels can be used to secure the panels of the side walls. The side wall modules or sections can be bolted together using bolt plates to secure the modules to one another. X-bracing inside the step between the side walls help align the side walls.

Reinforcing ribs on treads and platform slabs strengthen these components or modules where needed.

Brick, stone, or plain finishes are available for risers.

Different style of noses are available for the treads, e.g., chiseled stone, square, bullnose, etc. The treads may have different styles and finishes also, e.g., plain, broomed, stone, non-skid, etc.

Embossed indents or recesses relieve some of the weight of the modules, without compromising strength.

Sides, risers, treads, and platform slabs can be made at the factory or shop and shipped as a kit to the customer's property where the modules are assembled and installed. The parts are selected so the step unit is a custom fit. Each part is limited in weight so that the modules can each be carried by two workmen.

The sides which define the stepped front edge or stringer for holding the risers and treads can be made of two or more panels, and can be held together using a concrete adhesive and/or mechanical bracing. Tread and riser can be formed as unitary panels, rather than separate riser panels and tread panels, such that they seat on the stepped edge of the side walls. Additional platform panels can extend the concrete porch steps back beyond the top step tread.

Higher, multiple deck concrete steps can also be constructed with several flights of steps and a deck or landing between flights.

Side rails can be easily installed on one or both sides of the step units.

Molded concrete foot pieces may be used to support the modular step unit on ground rather than on a poured concrete slab, where the unit will be less susceptible to frost heave.

DETAILED DESCRIPTION

Figure 1:
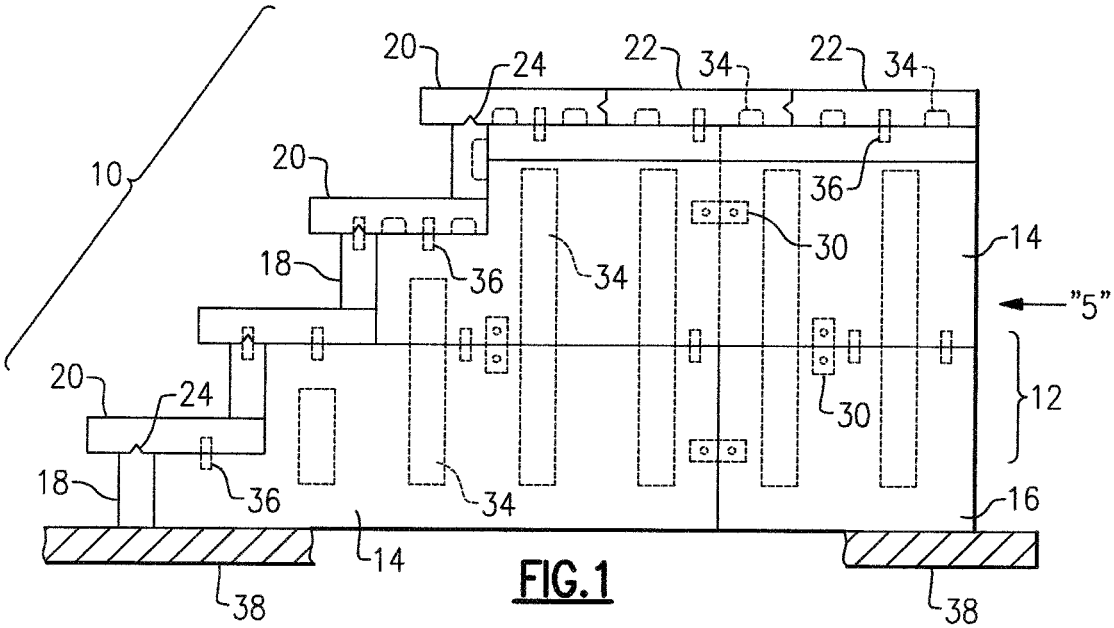
FIG. 1 is a side elevation, partly in broken line to show features on the reverse side of the side wall, of a modular concrete step of the present invention.

FIG. 1 shows the step unit 10 having a side wall 12 being formed of an assembly of two modular stepped side modules 14, 14 staggered in position, and a square or rectangular modular panel 16 at the back end of the lower module 14. Also shown are the riser modules 18 and steps or tread modules 20, and a pair of platform tread modules 22 in place behind the top step tread. A keyway 24 can be fitted into a mating recess in the tread module to lock in place the riser module 18 to the supported tread module 22. Note that there can be recesses or cutouts 34 (shown in broken line) formed on the under side of the modules 22 and on the inward sides of the side wall modules 14, 16, that serve to relieve some of the weight of the tread module 20 and side wall module without any loss in strength of the module. Also shown here, pins or dowels 36 are configured for fitting into corresponding recesses or sockets in the side wall panels, and are intended for joining the tread modules to the walls and also joining a platform slab base 38 unit to the bottom edge of the side walls. The pins and dowels 36 are oriented vertically and fit into respective complementary ones of said recesses, with recesses being located on edge surfaces of the respective pre-cast concrete sidewall panels.

Figure 2:
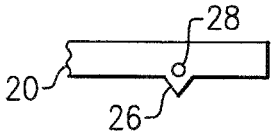
FIG. 2 shows a tread in cross-section to reveal a reinforcing rib and re-rod.
Figure 3:
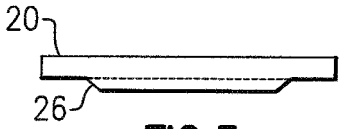
FIG. 3 is a front view of the tread with reinforcing rib.
Figure 4:
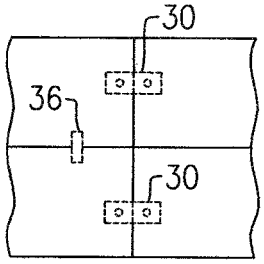
FIG. 4 shows a portion of the reverse side of the side wall shown in FIG. 1, featuring bracket plates holding several modular panels together.
Figure 5:
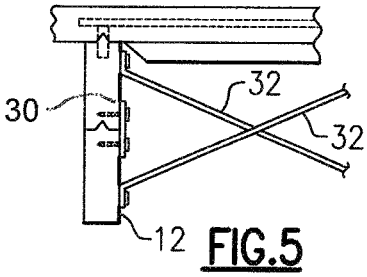
FIG. 5 is a partial rear view, taken at "5" in FIG. 1, showing an X bracing or cross-bracing feature.
Figure 6:
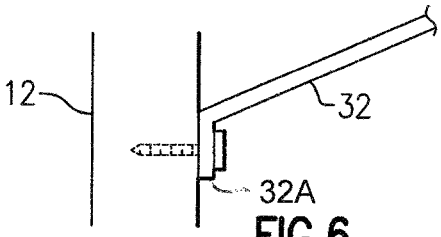
FIG. 6 is a partial enlargement of a portion of FIG. 5 showing a portion of the steel cross brace bolted to one side-wall module.

As shown in FIGS. 2 and 3, the treads 20 can have a transverse reinforcing rib 24 and a reinforcing steel rod 26. As shown in FIG. 4, steel plates 30 can be fastened, e.g., with bolts, across the seams joining adjacent side wall panel modules. These plates 30 are affixed onto the inward side of the step unit. As shown in FIG. 5, the steel reinforcing plate 30 favorably spans across a seam between adjacent side panel members and is bolted to the respective panel members on either side of the seam. In addition, cross-bracing 32 is used to brace the left and right side walls 12 to one another to keep the left and right side walls aligned, as shown in FIGS. 5 and 6, with a portion of the steel cross brace member 32 being shown in FIG. 6. Favorably, the cross brace members 32 are arranged in pairs each being a continuous member extending from one wall to the other, with the pair extending along crossed diagonals between the left and right side walls. As shown in FIG. 6, each cross brace member 32 has an angled foot member 32A at each end, which is bolted directly into the respective side wall 12 on its inside surface.

Figure 7:
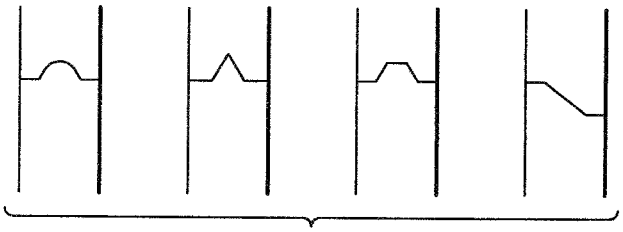
FIG. 7 shows some of the typical joints that may be used for mating side panel modules for the side walls.

FIG. 7 illustrates in cross section a number of possible keyway designs that may be used for aligning and joining the side modules to one another or the tread and platform slabs to one another. These four are illustrative only, and do not limit the shape or profiles to any specific design of keyway. These may permit stacking of modules one above the other, with or without cement or mortar.

Figure 8:
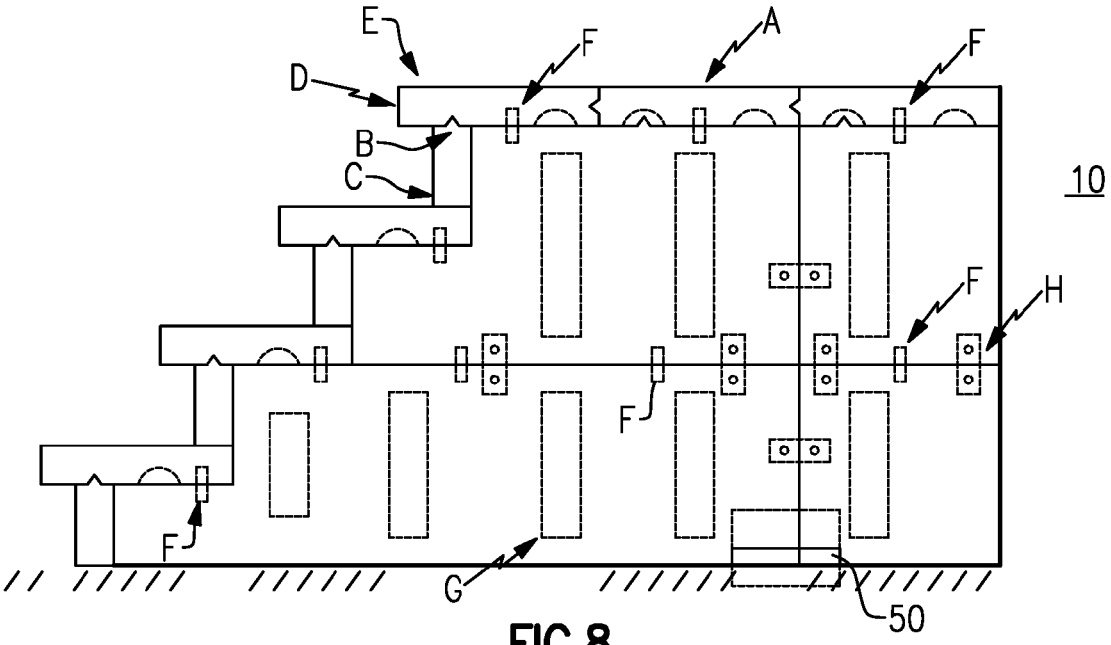
FIG. 8 is a side elevation of another possible modular step assembly.
Figure 9:
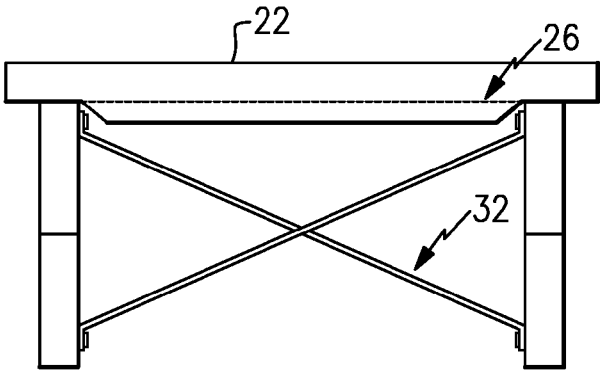
FIG. 9 is a rear view thereof showing the cross-bracing.

FIG. 8 is another side view illustrating another similar embodiment. Upper surfaces E of the stair treads may have a surface treatment to satisfy the customer's desire, e.g. plain, broomed, stone dust, brick face, non-skid, etc. The tread modules may have noses D with any desired amount of overhang, and maybe in the form of chiseled, square, bullnose, etc. Pins or dowels F are used to connect the side wall panel modules to one another and to position the stair tread modules and the top platform module, as shown. In some cases where it is envisioned that some modules may need to be removed and replaced, the attachment may be by these pins or dowels F only, not employing mortar or cement at those locations. Also as shown in broken line, the reverse or inner side of the side wall panel modules may have cut-aways or recesses G, i.e., embossments, to relieve some of the weight of the modules. These do not compromise the vertical strength of the assembled step unit. FIG. 9 shows also the top platform module(s) 22 having a lateral reinforcing rib 26 at its underside. This view, from the rear or high end of the assembled step unit, also shows the cross bracing using the steel cross braces 32 at crossed diagonals. There can typically be several pairs of cross brace members from front to back.

Figure 10:
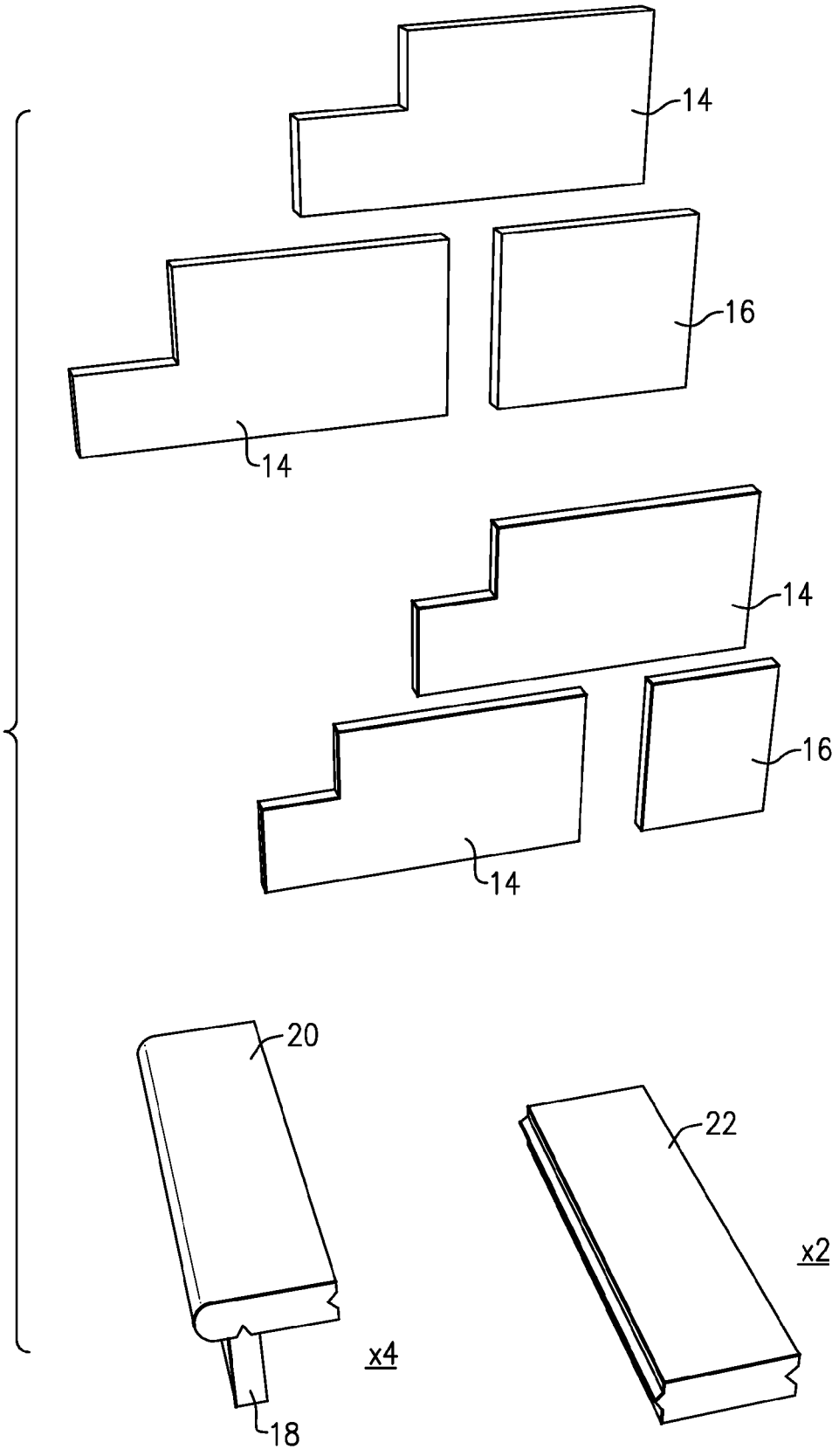
FIG. 10 is an exploded view of the major modular concrete panel elements employed in the construction of the modular step assembly of FIG. 8.

FIG. 10 is an assembly view showing the major concrete modules needed to create the concrete step 10 of this embodiment. Here there are four of the modules 14, two of the modules 16, four each of the risers 18 and treads 20 and two additional top platform slabs 22. For a higher or longer concrete step, a different set of these modules would be needed. In this case each of the modules has a weight of 250 pounds or less, most less than 200 pounds, and each can be carried from the truck to the installation site by hand, carried by two workmen. The modules are interchangeable also, so that any of them can be replaced with a similar module, if need be. The hardware such as the steel plates 30 and the pins or dowels 36 would be included in the kit, but are not shown in this view.

Figure 11:
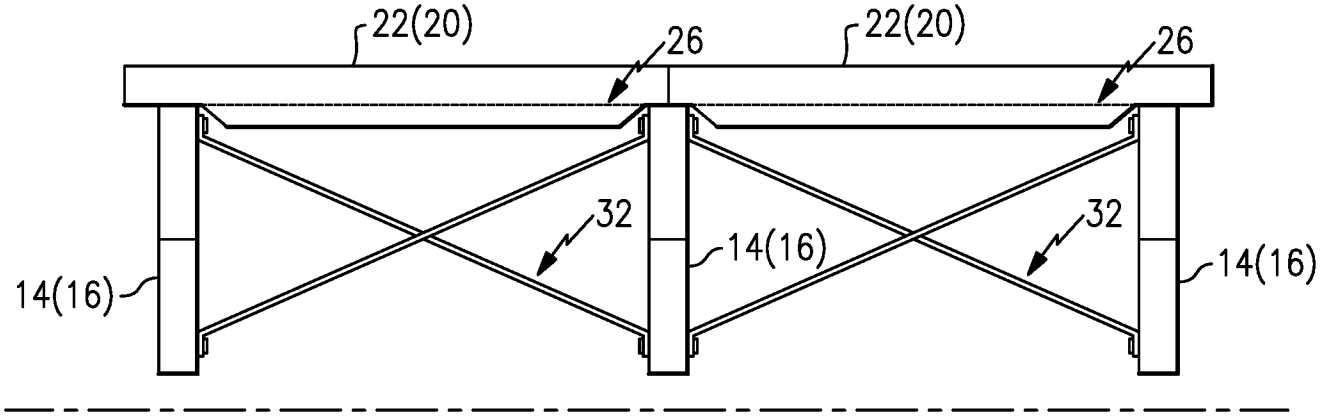
FIG. 11 is a rear view of an alternative, double-width embodiment.

FIG. 11 illustrates a double-width step unit, shown from the same aspect as FIG. 9, and with similar reference numbers identifying similar elements. There are left, right and center stepped walls formed of the wall modules 14 and/or 16, and these support the edges and middle part of the tread modules 20 and 22, which in this case may be double length or, as shown here formed of two modules set in end-to-end. The tread modules are shown here with the optional reinforcing rib 26. The cross brace members 32 are installed as shown here in a rear elevation so as to extend diagonally downward from an upper part of one wall to the lower part of the opposite wall, and shown here with cross-brace members 32 extending between the right side wall and the center wall and also between the center wall and the left side wall.

Figure 12:
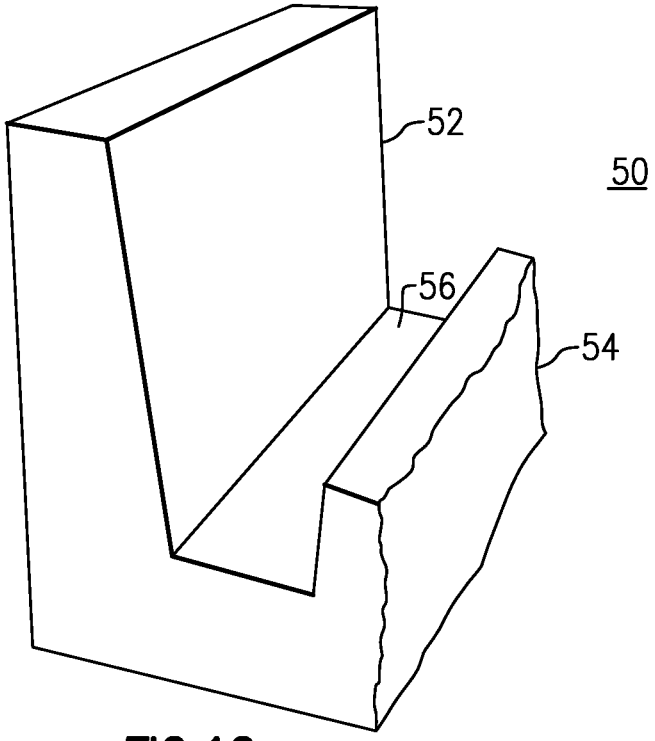
FIG. 12 is a perspective view of a foot piece for the modular step assembly.
Figure 13:
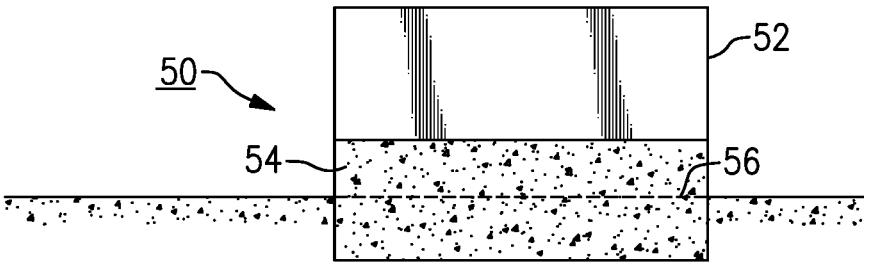
FIG. 13 is an elevation thereof.

A footing piece 50 for supporting the side wall module or modules 14, where there is no poured concrete slab, is shown in FIGS. 12 and 13. Here the footing piece 50 has a vertical back plate 52, a front panel 54 and a base 56. The facing surfaces of the back plate 52 and front panel 54 taper inward to the base 56, and define a tapered slot for the lower edge of the side wall module 14 so it can rest securely on the upper surface of the base 56. These footing pieces 50 are set into the ground, favorably in a gravel layer so that the support surface of the base 56 is at grade level (FIG. 13). The back plate 52 is at the inside of the modular step unit, and the front panel is on the exterior. The front panel can have a textured surface, e.g., simulated stone or as appropriate to match the step unit. A typical step unit may require two or three footing pieces 50 per side. One footing piece 50 is shown at a typical position in FIG. 8.

While this embodiment employs elements cast of reinforced concrete, it is possible that at least some of these modules may be made of a composite material, e.g., including fiber and/or tough plastic materials. The outer or visible surfaces can be textured as desired, and may be made in any desired color to suit the building or other components of the installation.

While the invention is described in terms of a preferred embodiment, the invention is not limited only to that embodiment, but rather many modifications and variations are possible without departing from the main spirit and principles of the invention.

What is claimed is:

1. A precast concrete step unit formed of left and right side walls, risers, and treads, wherein said left and right side walls are each comprised of a plurality of pre-cast stepped sidewall panel modules, including at least one stepped panel module and at least one rectangular panel module, said panel modules being joined edge-to-edge at seams of the respective side wall to form the respective side wall;

a plurality of pre-cast concrete tread modules each extending at least between said left and right side walls and affixed onto respective stepped edge surfaces of said at least one stepped panel module of said right and left side walls;

a plurality of pre-cast concrete riser modules each extending at least between said right and left side walls and affixed onto respective ones of said tread modules, and each said riser module extending vertically to a successive stepped edge surface of the at least one stepped panel module of each of said right and left walls; a plurality of flat reinforcing plates, each fastened with bolts into adjacent panel modules of said left and right side walls across the seams that join the adjacent side panel models thereof; pins or dowels adapted for positioning and joining said tread modules to said sidewall panel modules; and further comprising at least a pair of continuous cross brace members joining the left and right side walls to one another, each of said cross brace members having a foot member at each end thereof, said foot member being bolted into a respective one of said left and right side walls at a respective surface thereof.

2. The precast concrete step unit according to claim 1 wherein said pins or dowels are adapted for fitting into recesses adapted for receiving said pins or dowels, said recesses being positioned at corresponding positions in said sidewall panels.

3. The precast concrete step unit according to claim 2, wherein said pins or dowels are oriented vertically and fit into respective complementary ones of said recesses, with said recesses being located on edge surfaces of the respective pre-cast concrete sidewall panels.

4. The precast concrete step unit according to claim 1 wherein each of said pre-cast modules has a weight of less than 250 pounds.

5. The precast concrete step unit according to claim 1 wherein said cross brace members each extend diagonally downward from an upper part of one of said left and right side walls to a lower part of the other of said left and right side walls.

6. The precast concrete step according to claim 1 further comprising a plurality of footing pieces each supporting one or more of said side walls with each said footing piece being unitarily formed of a vertical back plate, a front panel, and a base supporting the back plate and the front panel in spaced relation to one another, and with facing surfaces of the back plate and front panel tapering inward towards said base so as to define a tapered slot therebetween.

7. A precast concrete step unit formed of left and right side walls, risers, and treads, wherein said left and right side walls are each comprised of a plurality of pre-cast stepped sidewall panel modules, including at least one stepped panel module and at least one rectangular panel module, said panel modules being joined edge-to-edge at seams that are defined between adjacent ones of said panel modules of the respective side wall that form the respective side wall;

a plurality of pre-cast concrete tread modules each extending at least between said left and right side walls and affixed onto respective stepped edge surfaces of said at least one stepped panel module of said right and left side walls;

a plurality of pre-cast concrete riser modules each extending at least between said right and left side walls and affixed onto respective ones of said tread modules, and each said riser module extending vertically to a successive stepped edge surface of the at least one stepped panel module of each of said right and left side walls; and further comprising a plurality of flat reinforcing plates each fastened with bolts into adjacent panel modules of said left and right side walls across the seams that join the respective side panel modules thereof and pins or dowels adapted for positioning and joining said tread modules to said sidewall panel modules.

8. A precast concrete step unit formed of left and right side walls and a similar center wall, and risers, and treads, wherein said left and right side walls and said center wall each comprise a plurality of pre-cast stepped sidewall panel modules, including at least one stepped panel module and at least one rectangular panel module, said panel modules being joined edge-to-edge at seams of the respective side wall to form the respective side wall;

a plurality of pre-cast concrete tread modules each extending at least between said left and right side walls and affixed onto respective stepped edge surfaces of said at least one stepped panel module of said right and left side walls and said center wall;

a plurality of pre-cast concrete riser modules each extending at least between said right and left side walls and affixed onto respective said tread modules, and each extending vertically to successive stepped edge surface of the at least one stepped panel module of each of said left and right walls and said center wall; a plurality of flat reinforcing plates, each fastened with bolts into adjacent panel modules of said left and right side walls across the seams that join the adjacent side panel models thereof; pins or dowels adapted for positioning and joining said tread modules to said sidewall panel modules; and further comprising at least a pair of continuous cross brace members joining the left side wall to said center wall and at least another pair of continuous cross brace members joining the center wall and and the right side wall to one another, each of said cross brace members having a foot member at each end thereof one said foot member at one end being bolted onto a respective one of said side walls at to a respective surface thereof; and the foot member at an opposite end being bolted onto said center wall.

9. The precast concrete step unit according to claim 8 wherein a plurality of said pins or dowels are configured so as to position and join predetermined ones of said sidewall panel modules to a platform slab base unit.

10. The precast concrete step unit according to claim 8, wherein said pins or dowels are oriented vertically and fit into respective recesses on edge surfaces of adjacent ones of said sidewall panel modules, said recesses being formed complementary to the respective pins or dowels and adapted to mate onto the respective pins or dowels.

11. The precast concrete step unit according to claim 8 wherein each of said pre-cast concrete modules has a weight of less than 250 pounds.

12. The precast concrete step according to claim 8 wherein said cross brace members each extend diagonally downward from an upper part of one of said left and right wall to a lower part of said center wall.

13. The precast concrete step according to claim 8 further comprising a plurality of footing pieces each supporting one or more of said side walls with each said footing piece being unitarily formed of a vertical back plate, a front panel, and a base supporting the back plate and the front panel in spaced relation to one another, and with facing surfaces of the back plate and front panel tapering inward towards said base so as to define a tapered slot therebetween.

* * * * *